US005990626A

United States Patent [19]

Heuvelmans et al.

[11] Patent Number: 5,990,626

[45] Date of Patent: Nov. 23, 1999

[54] LIGHTING UNIT, LOW-PRESSURE MERCURY DISCHARGE LAMP, SUPPLY UNIT, AND COMBINED PACKAGING

[75] Inventors: Jean J. Heuvelmans, Eindhoven; Abraham L. De Smit, Terneuzen, both of Netherlands

[73] Assignee: U.S. Philips Corporation, New York, N.Y.

[21] Appl. No.: 09/023,601

[22] Filed: Feb. 13, 1998

[30] Foreign Application Priority Data

Feb. 14, 1997 [EP] European Pat. Off. ..... 97200420

[51] Int. Cl.[6] ..... H05B 37/00

[52] U.S. Cl. ..... 315/94; 315/56; 313/484

[58] Field of Search ..... 315/291, 219, 315/326, 358, 349, 355, 356, 363, 50, 94, 101, 95, 96, 97, 56; 313/484, 491, 573, 574, 575, 576, 485

[56] References Cited

U.S. PATENT DOCUMENTS 5,233,268 8/1993 Heuvelmans et al. ..... 313/491
5,341,067 8/1994 Nilssen ..... 315/209
5,406,174 4/1995 Slegers ..... 315/219
5,498,930 3/1996 Loy et al. ..... 315/97

*Primary Examiner*—David H. Vu
*Attorney, Agent, or Firm*—F. Brice Faller

[57] ABSTRACT

A lighting unit according to the invention comprises a supply unit (1) and a low-pressure mercury discharge lamp (2). The low-pressure mercury discharge lamp has a light-transmitting discharge vessel (3) which is provided with a luminescent layer (3) on an inner surface and which encloses in a gastight manner a discharge space (4) which is provided with a filling comprising mercury and one or several rare gases. A first (5*a*) and a second electrode (5*b*) are arranged in the discharge space, each comprising a coiling of a metal wire coated with one or several electron-emitting metal oxides. Each electrode is electrically connected to a respective current supply conductor (6*a*, 6*b*) which extends to outside the discharge vessel (3). The current supply conductors are electrically connected to the supply unit outside the discharge vessel, the unit ignites the low-pressure mercury discharge lamp in the state upon switching-on. During nominal operation, at least a portion (5*a) of each electrode (5***a*, 5*b*) passes an electrode current Iel having an effective value Īel which is at least 1.8 times the minimum electrode current Ip4 required for thermal emission. The lighting unit according to the invention has a long switching life.

9 Claims, 2 Drawing Sheets

LIGHTING UNIT, LOW-PRESSURE MERCURY DISCHARGE LAMP, SUPPLY UNIT, AND COMBINED PACKAGING

BACKGROUND OF THE INVENTION

The invention relates to a lighting unit comprising a supply unit and a low-pressure mercury discharge lamp, which low-pressure mercury discharge lamp has a light-transmitting discharge vessel which is provided with a luminescent layer on an inner surface and which encloses a discharge space in a gastight manner, the discharge space being provided with a filling comprising one or several rare gases in addition to mercury. In this discharge space a first and a second electrode are positioned, which electrodes each comprise a coiling of a metal wire coated with one or several metal oxides which emit electrons, and which electrodes are each electrically connected to a respective current supply conductor which extends to outside the discharge vessel and is electrically connected there to the supply unit, which unit ignites the low-pressure mercury discharge lamp in the cold state upon switching-on.

Lighting units with a low-pressure mercury discharge lamp, also referred to as "lamp" hereinafter, are widely used for general lighting purposes. They render possible a considerable energy saving owing to the high luminous efficacy in comparison with that of incandescent lamps.

A discharge is maintained with a discharge current between the electrodes during nominal operation of the lighting unit. The manner in which the lamp is ignited depends on the type of lighting unit.

In a lighting unit of the "hot start" type, the electrodes each have a further current supply conductor. Before an ignition voltage is applied between the electrodes, the latter are brought to a temperature required for nominal operation by means of an auxiliary current from the current supply conductor to the further current supply conductor. This method of igniting, however, leads to a comparatively long delay, called ignition delay hereinafter, between the moment of switching-on of the lighting unit and actual lamp ignition. This is a disadvantage. Moreover, the provisions required for this render such a lighting unit comparatively expensive.

In a lighting unit of the "rapid start" type, the electrodes also each have a further current supply conductor, and the electrodes are given a raised temperature by means of an auxiliary current. It is true that an ignition voltage is applied immediately after switching on in this type of lighting unit. An ignition delay is realized here, however, in that the ignition voltage is insufficiently high for igniting the lamp with its still cold electrodes. The lamp does not ignite until after the electrodes have assumed a sufficiently high temperature.

A lighting unit of the kind described in the opening paragraph, in which the lamp ignites in the cold state, is described in U.S. Pat. No. 5,341,067. In such a lighting unit, also referred to as "cold start" or "instant start", an ignition voltage is applied between the electrodes of a sufficient level for igniting the lamp practically immediately after switching-on, i.e. with an ignition delay of less than 100 ms. The electrodes only assume their nominal operational temperature after ignition. A further current supply conductor to the electrodes is not necessary in lighting units of this type. The electrodes are exclusively heated by the discharge arc applied thereto and by the discharge current during nominal operation in this case. If the electrodes have a further current supply conductor, an auxiliary current may contribute to maintaining the nominal operational temperature of the electrodes.

The lamps of the lighting units mentioned above in general have a long life in continuous operation. The life of lighting units in which the lamps are ignited in the cold state is limited in practice by the switching life of the lamp, i.e. the number of times the lamp can be switched on. It was in fact found that the ignition of the lamp whose electrodes are still cold causes comparatively much damage to the electrodes, so that the electrode becomes defective after a comparatively small number of switching operations. To reduce the switching frequency, the lamps are often operated continuously also in cases where the need for lighting is of short duration only. This strongly detracts from the energy saving which could be achieved in comparison with incandescent lamps.

SUMMARY OF THE INVENTION

It is an object of the invention to provide a lighting unit in which the lamp is ignited substantially immediately after switching-on and which nevertheless has a long switching life.

According to the invention, during nominal operation at least a portion of each of the electrodes passes an electrode current Iel with an effective value $\bar{I}$el of at least 1.8 times the minimum electrode current Ip4 required for thermal emission. The effective value $\bar{I}$ of a current I is defined as:

$$\bar{I} = 1/T\sqrt{\int_0^T I^2 dt}\,,,$$

in which T is the duration of one cycle of the current I. The temperature of the electrode is exactly high enough for thermal emission to occur in the case of an electrode current having an effective value equal to Ip4. This temperature is approximately 950 K. Tungsten electrodes have a resistance at this temperature which is four times that at room temperature. The electrodes assume a comparatively high hot spot temperature in the location where the arc applies itself in the case of an electrode current having an effective value $\bar{I}$el of at least 1.8 times Ip4. Surprisingly, the lamp of the lighting unit according to the invention has a considerably longer switching life in spite of the heavier thermal load on its electrodes. A possible explanation for this is that the metals whose oxides are used as electron emitters play an important part during lamp ignition. It is assumed that the higher hot spot temperature reduces the electron-emitting metal oxides, for example barium oxide, to the respective metals, for example barium, at a faster rate, so that this metal is accordingly available in a sufficient quantity also during short operating times of the lamp. Preferably, the effective value $\bar{I}$el of the electrode current is at most 3.0 times Ip4. Higher values will lead to an excessive shortening of lamp life in the case of continuous operation owing to attacks on the metal wires of the electrodes.

In an embodiment of the lighting unit according to the invention, the electrode current Iel is the discharge current Id. In a favourable embodiment, the electrodes each have a respective further current supply conductor, a discharge current Id flowing from the first to the second electrode during nominal operation, while an auxiliary current Ih flows from the current supply conductor to the further current supply conductor. The electrode current Iel in that case is the sum of the discharge current Id and the auxiliary current Ih.

Preferably, the ratio $\bar{I}$h/$\bar{I}$d is at most 1.0. A comparatively strong loss of emitter material occurs in the electrodes with a ratio above 1.0.

According to a favorable embodiment the supply unit is provided with a high-frequency circuit arrangement with a first and a second output terminal and is provided with inductive and capacitive means. The first output terminal is connected to the current supply conductor of the first electrode via the inductive means, and the second output terminal is connected to the current supply conductor of the second electrode, while the further current supply conductors of the electrodes are interconnected via the capacitive means. The capacitive means together with the inductive means form a resonant circuit which causes an ignition voltage to arise after the lighting unit has been switched on. If one of the electrodes has become defective, the circuit with the capacitive means is broken, so that no ignition voltage can be generated anymore. Unsafe situations at the end of lamp life are avoided thereby. The values of the auxiliary current and the discharge current can be adjusted in a simple manner through the choice of the capacitive and inductive means.

In an attractive embodiment, the electron-emitting metal oxide of the electrodes comprises barium oxide, calcium oxide, and strontium oxide.

The lamp and the supply unit may be integrated into one unit. Alternatively, the lamp may be detachably coupled to the supply unit. The invention accordingly also relates to a low-pressure mercury discharge lamp provided with a first coupling member specially adapted for cooperation with a second coupling member of a supply unit for the electrical and mechanical coupling of the low-pressure mercury discharge lamp to the supply unit, such that the low-pressure mercury discharge lamp and the supply unit in the coupled state constitute a lighting unit according to the invention.

The invention also relates to a supply unit provided with a second coupling member which is specially adapted for cooperation with a first coupling member of a low-pressure mercury discharge lamp for the electrical and mechanical coupling of the low-pressure mercury discharge lamp to the supply unit, such that the low-pressure mercury discharge lamp and the supply unit in the coupled state constitute a lighting unit according to the invention.

Since the first and the second coupling member are specially adapted to cooperate with one another, it will be clear which combination of supply unit and low-pressure mercury discharge lamp should be chosen for achieving the object of the invention.

Alternatively, a supply unit and a low-pressure mercury discharge lamp forming a combination suitable for achieving the object may be packed together.

The invention accordingly also relates to a combined packaging containing a low-pressure mercury discharge lamp provided with a first coupling member and a supply unit provided with a second coupling member, which first and second coupling member have a mutually cooperating state in which they couple the low-pressure mercury discharge lamp electrically and mechanically to the supply unit such that the low-pressure mercury discharge lamp and the supply unit constitute a lighting unit according to the invention. The very fact that the two are packed together in itself indicates that this combination of lamp and supply unit forms a lighting unit according to the invention. It is not necessary then for the coupling members to be capable of cooperation exclusively with one another.

The first and the second coupling member may have, for example, separate means for electrically and for mechanically coupling the low-pressure mercury discharge lamp to the supply unit.

The mechanical coupling means may be, for example, a snap connection, a clamp connection, or a screw connection.

In an embodiment, the electrical coupling means are realized in that the first and the second coupling member each comprise a coil, said coils forming a transformer together with the supply unit in the coupled state of the low-pressure mercury discharge lamp.

In an alternative embodiment, the electrical coupling means are realized, for example, in the form of contact pins which can be held with clamping fit in contact sockets of the supply unit. These means may at the same time be the means for mechanical coupling.

DESCRIPTION OF THE PREFERRED EMBODIMENTS

Figure 1:
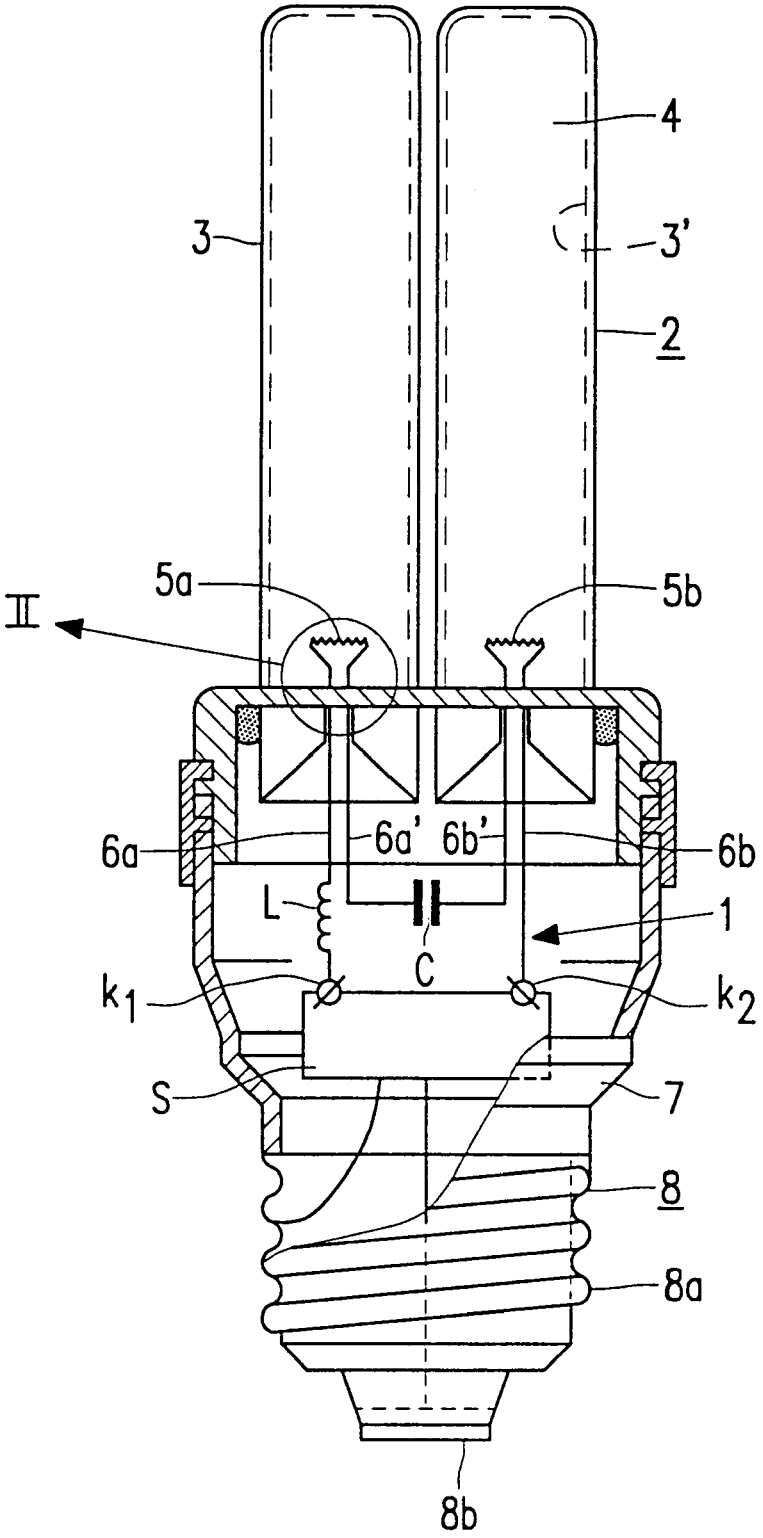
FIG. 1 shows a first embodiment of the lighting unit according to the invention.
Figure 2:
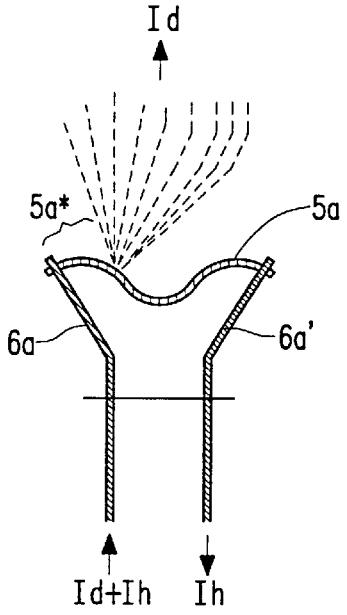
FIG. 2 shows a detail II from FIG. 1.

The lighting unit according to the invention shown in FIG. 1 comprises a supply unit 1 and a low-pressure mercury discharge lamp 2. The lighting unit can serve as a replacement for an incandescent lamp. The low-pressure mercury discharge lamp 2 has a light-transmitting discharge vessel 3 which is provided with a luminescent layer 3' on an inner surface. The discharge vessel 3 encloses a discharge space 4, which is provided with a filling of mercury and argon, in a gastight manner. A first and a second electrode 5*a*, 5*b* are arranged in the discharge space 4. FIG. 2 shows the electrode 5*a* in more detail. The electrode 5*b* is of a similar construction. The electrodes 5*a*, 5*b* each comprise a metal coil coated with one or several electron-emitting metal oxides. The electrodes are formed from a triple coiling of tungsten wire with a diameter $d_{el}$ of 24 $\mu$m in this case, coated with a mixture of barium oxide, calcium oxide, and strontium oxide. The minimum electrode temperature required for thermal emission is 950 K. The current Ip4 required for achieving this temperature is 60 mA for these electrodes. The electrodes 5*a*, 5*b* are each electrically connected to a respective current supply conductor 6*a*, 6*b* which extends to outside the discharge vessel 3 and is connected to the supply unit 1 there. The electrodes 5*a*, 5*b* are also each connected to a respective further current supply conductor 6*a*', 6*b*' which extends to outside the discharge vessel 3.

The supply unit 1 is accommodated in a housing 7 which supports the lamp 2 and a lamp cap 8. The supply unit 1 is provided with a high-frequency circuit arrangement S having a first and a second output terminal K1, K2 and having inductive means L and capacitive means C. The high-frequency circuit arrangement S supplies an AC voltage with a frequency of 50 kHz. The first output terminal K1 of the circuit arrangement S is connected to the current supply conductor 6*a* of the first electrode 5*a* via inductive means L. The second output terminal K2 is connected to the current supply conductor 6*b* of the second electrode 5*b*. The further current supply conductors 6*a*', 6*b*' of the electrodes are interconnected via the capacitive means C. The inductive means L are formed by a coil having a self-inductance of 3.1 mH. A capacitor having a capacitance value of 4.7 nF forms the capacitive means C. The supply unit 1 is connected to contacts 8*a*, 8*b* of the lamp cap 8.

Contributions to the electrode current Iel are formed by a discharge current Id with an effective value $\bar{I}d$ of 135 mA which maintains the discharge and an auxiliary current Ih with an effective value $\bar{I}h$ of 100 mA flowing through each electrode 5*a*, 5*b* from its current supply conductor 6*a*, 6*b* to its further current supply conductor 6*a*', 6*b*' and providing additional heating for the electrode. The discharge current Id flows through an end portion 5*a of the electrode 5***a*, 5*b* which extends between its current supply conductor 6*a*, 6*b* and the location where the discharge arc applies itself to the electrode. The currents Id and Ih in this example show a phase difference ϕ of approximately 90°. The ratio $\bar{I}h/\bar{I}d$ is smaller than 1.0, i.e. 0.74 in the present case.

During nominal operation, an electrode current Iel with an effective value $\bar{I}el$ of 165 mA flows through said end portion 5*a of the electrodes 5***a*, 5*b*. This value is more than 1.8 times the minimum current Ip4 required for thermal emission. The value of $\bar{I}el$ is 2.8 times Ip4 in this case. The lamp in this lighting unit consumes a power of 10 W.

The lighting unit according to the invention described above is referred to below as "inv1". A lighting unit not according to the invention (ref1) differs from this in that the effective value $\bar{I}el$ of the electrode current is no more than 1.5 times Ip4. The lamp consumes a power of 7 W.

In a further lighting unit according to the invention (inv2), the electrode is a triple coiled tungsten wire with a diameter $d_{el}$ of 38 μm, again coated with a mixture of barium oxide, calcium oxide, and strontium oxide. The discharge vessel contains a filling of mercury and a mixture of neon and argon. The effective value $\bar{I}el$ of the electrode current is 2.0 times Ip4 during nominal operation. The ratio $\bar{I}h/\bar{I}d$ is smaller than 1.0, i.e. 0.74 in the present case. A further lighting unit not according to the invention (ref2) differs from the lighting unit inv2 in that the effective value $\bar{I}el$ of the electrode current is no more than 1.6 times Ip4. The lamps of the lighting units inv2 and ref2 consume a power of approximately 16 W during nominal operation.

Six lighting units of the embodiment inv1 and six of the embodiment inv2 according to the invention and five lighting units of the embodiment ref1 and five of the embodiment ref2 not according to the invention were switched on and off periodically for one minute and three minutes, respectively, so as to determine their switching lives. The lamps were ignited cold with an ignition voltage of 750 Vrms, with the result that they ignited within 100 ms after switching-on of the lighting unit. The results are given in the Table below. Ths therein is the hot spot temperature of the electrode, and Ns is the switching life.

| | $d_{el}$ (μm) | Ip4 (mA) | $\bar{I}d$ (mA) | $\bar{I}h$ (mA) | $\bar{I}el$ (mA) | $\bar{I}el$/Ip4 | Ths (K) | Ns |
|---|---|---|---|---|---|---|---|---|
| inv1 | 24 | 60 | 135 | 100 | 165 | 2.8 | 1750 ± 50 | 12000 ± 3500 |
| ref1 | 24 | 60 | 90 | 30 | 95 | 1.5 | 1400 ± 50 | 3000 ± 1500 |
| inv2 | 38 | 125 | 195 | 145 | 250 | 2.0 | 1600 ± 50 | 13000 ± 4000 |
| ref2 | 38 | 125 | 180 | 60 | 195 | 1.6 | 1450 ± 50 | 4500 ± 2000 |

It is apparent from the Table that the lighting units inv1 and inv2 according to the invention, in which the effective value $\bar{I}el$ of the electrode current is at least 1.8 times Ip4, have a considerably longer switching life than the lighting units ref1 and ref2 not according to the invention.

Figure 3:
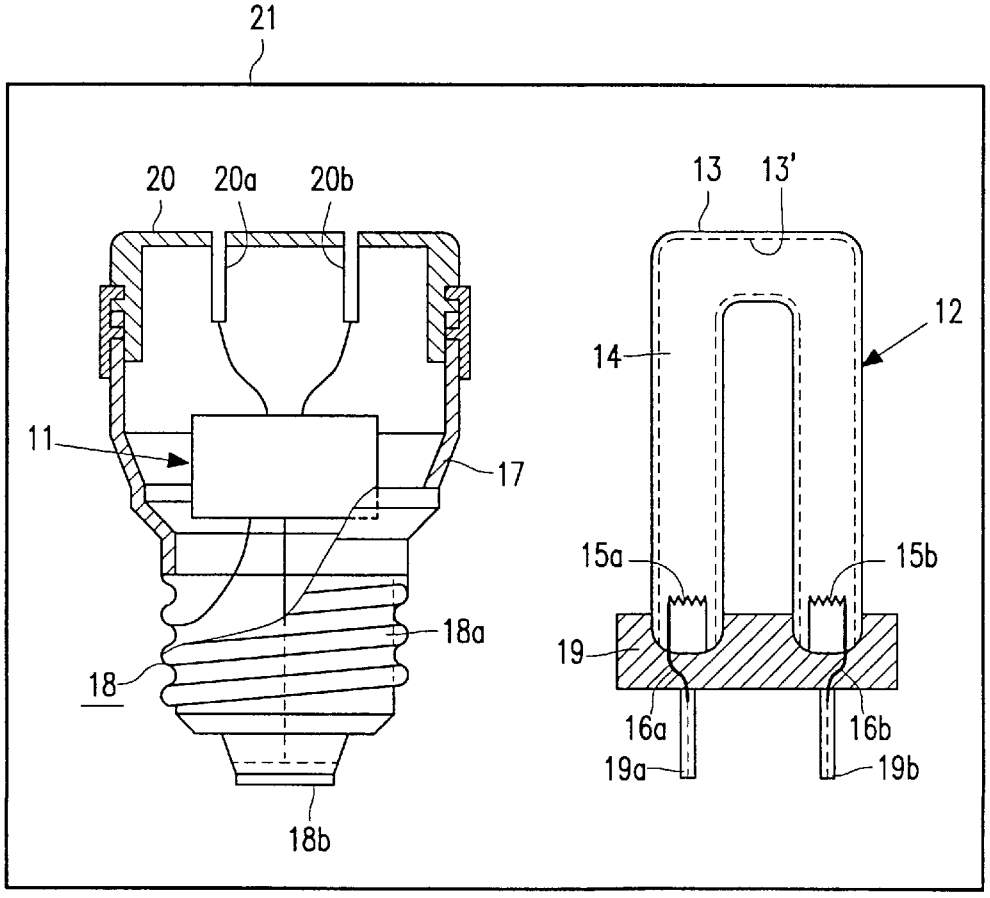
FIG. 3 shows a second embodiment of the lighting unit according to the invention.

A second embodiment of the lighting unit according to the invention is shown in FIG. 3. Components therein which correspond to those in FIG. 1 have reference numerals which are 10 higher. In the embodiment shown, the low-pressure mercury discharge lamp 12 is provided with a first coupling member 19. The supply unit is provided with a second coupling member 20. The supply unit is accommodated in a housing 17 which supports a lamp cap 18 with contacts 18*a* and 18*b*. The first coupling member 19 and the second coupling member 20 are mutually specially adapted so as to cooperate in realizing an electrical and a mechanical coupling of the low-pressure mercury discharge lamp 12 to the supply unit 11. The combination of the low-pressure mercury discharge lamp 12 and the supply unit 11 is accommodated in a packaging 21. The low-pressure mercury discharge lamp 12 and the supply unit 11 together form a lighting unit according to the invention in the coupled state.

In FIG. 3, contact pins 19*a*, 19*b* which can be held with clamping fit in contact sockets 20*a*, 20*b* of the supply unit 11 form means for the electrical as well as the mechanical coupling between the low-pressure mercury discharge lamp 12 and the supply unit 11. The further current supply conductors of the electrodes are not connected in FIG. 3. In a modification of this embodiment, the further current supply conductors are interconnected inside the first coupling member via an impedance, for example a capacitive impedance, so that not only a discharge current flows between the electrodes during operation, but an auxiliary current also flows through the electrodes. In another embodiment, the further current supply conductors are also connected to contact pins which cooperate with contact bushes.

We claim:

1. A lighting unit comprising a supply unit (1; 11) and a low-pressure mercury discharge lamp (2; 12), which low-pressure mercury discharge lamp has a light-transmitting discharge vessel (3; 13) which is provided with a luminescent layer (3'; 13') on an inner surface and which encloses a discharge space (4; 14) in a gastight manner, said discharge space being provided with a filling comprising one or several rare gases in addition to mercury, while in this discharge space a first electrode (5*a*; 15*a*) and a second electrode (5*b*; 15*b*) are positioned, which electrodes (5*a*, 5*b*; 15*a*, 15*b*) each comprises a coil of a metal wire coated with one or several metal oxides which emit electrons, and which electrodes are each electrically connected to a respective current supply conductor (6*a*, 6*b*; 16*a*, 16*b*) which extends to outside the discharge vessel (3; 13) and is electrically connected to the supply unit, which unit ignites the low-pressure mercury discharge lamp in the cold state upon switching-on, characterized in that during nominal operation at least a portion (5*a) of each of the electrodes (5***a*, 5*b*) passes an electrode current Iel with an effective value $\bar{I}el$ of at least 1.8 times the minimum electrode current Ip4 required for thermal emission.

2. A lighting unit as claimed in claim 1, characterized in that the electrodes (5*a*, 5*b*) are each connected to a respective further current supply conductor (6*a*', 6*b*') which extends to outside the discharge vessel (3), a discharge current Id flowing from the first to the second electrode during nominal operation, while an auxiliary current Ih flows from the current supply conductor (6*a*, 6*b*) to the further current supply conductor (6*a*', 6*b*') of each electrode.

3. A lighting unit as claimed in claim 2, characterized in that the ratio $\bar{I}h/\bar{I}d$ is at most 1.0, $\bar{I}d$ and $\bar{I}h$ being the effective values of Id and Ih, respectively.

4. A lighting unit as claimed in claim 2, wherein the supply unit (1) is provided with a high-frequency circuit arrangement (S) with a first (K1) out put terminal and a second output terminal (K2) and provided with inductive (L) and capacitive means (C), said first output terminal (K1) being connected to the current supply conductor (6*a*) of the first electrode (5*a*) via the inductive means (L), and said second output terminal (K2) being connected to the current supply conductor (6*b*) of the second electrode (5*b*), while the further current supply conductors (6*a*', 6*b*') of the electrodes are interconnected via the capacitive means (C).

5. A lighting unit as claimed in claim 1 wherein the one or several electron-emitting metal oxides of the electrodes are barium oxide, calcium oxide and strontium oxide.

6. A lighting unit as in claim 1 wherein the low-pressure mercury discharge lamp (12) comprises a first coupling member (19, 19*a*, 19*b*) which is specially adapted to cooperate with a second coupling member (20, 20*a*, 20*b*) of said supply unit (11) for electrically and mechanically coupling the low-pressure mercury discharge lamp to the supply unit.

7. A lighting unit as in claim 1 wherein the supply unit (11) comprises a first coupling member (20, 20*a*, 20*b*) which is specially adapted to cooperate with a second coupling member (19, 19*a*, 19*b*) of said low-pressure mercury discharge lamp (12) for electrically and mechanically coupling the low-pressure mercury discharge lamp to the supply unit.

8. A lighting unit as in claim 1 wherein the low-pressure mercury discharge lamp (12) comprises a first coupling member (19, 19*a*, 19*b*) and the supply unit (11) comprises a second coupling member (20, 20*a*, 20*b*), which first and second coupling members have a mutually cooperating state in which they couple the low-pressure mercury discharge lamp electrically and mechanically to the supply unit.

9. A mercury vapor discharge lamp comprising a light transmitting discharge vessel having an inner surface provided with a luminescent layer and enclosing a discharge space in a gastight manner, said discharge space being provided with a filling comprising at least one inert gas and mercury, a first electrode and a second electrode in said discharge space, each electrode comprising a coil of metal wire coated with at least one metal oxide which emits electrons when the electrode is supplied with a minimum current Ip4 required for thermal emission, each electrode being connected to a respective current supply conductor which extends to outside the discharge vessel, and a supply unit connected to said current supply conductors outside of said discharge vessel, which supply unit comprises means for igniting the mercury vapor discharge lamp in the cold state upon switching on, and means for providing an electrode current Iel with an effective value $\bar{I}$el of at least 1.8 times the current Ip4 during nominal operation.

* * * * *